United States Patent [19]

Urani

[11] 4,176,906

[45] Dec. 4, 1979

[54] LOW PROFILE FUSE CLIP

[75] Inventor: Angelo Urani, St. Louis, Mo.

[73] Assignee: McGraw-Edison Company, Elgin, Ill.

[21] Appl. No.: 911,820

[22] Filed: Jun. 2, 1978

Related U.S. Application Data

[63] Continuation of Ser. No. 779,319, Mar. 21, 1977, abandoned.

[51] Int. Cl.[2] ..... H01R 13/12

[52] U.S. Cl. ..... 339/258 F

[58] Field of Search ..... 339/252 F, 253 F, 258 F, 339/259 F, 262 F

[56] References Cited

U.S. PATENT DOCUMENTS

| | | | |
|---|---|---|---|
| 734,407 | 7/1903 | Downes | 339/258 F |
| 2,229,989 | 1/1941 | Roby | 339/258 F |
| 2,942,228 | 6/1960 | Swick | 339/258 F |

FOREIGN PATENT DOCUMENTS

| | | | |
|---|---|---|---|
| 149822 | 8/1920 | United Kingdom | 339/258 F |

*Primary Examiner*—Joseph H. McGlynn

*Attorney, Agent, or Firm*—Bruce R. Mansfield; Jon Carl Gealow; Thomas E. McDonald

[57] ABSTRACT

A fuse clip, for a ferrule-like terminal of an electric fuse, has a base from which two arms extend upwardly to grip that ferrule-like terminal. Securing projections extend downwardly from, and extend below the level of, the bottom of that base to enter openings in a circuit board; and hence no part of that base need be overlain by any part of a rivet, bolt or other fastener. The upper ends of those arms are located below the level of the top of the ferrule-like terminal. The upper surface of the base has a line contact with the lowermost portion of the ferrule-like terminal, and each of the two arms also has a line contact with that ferrule-like terminal which is displaced at least one hundred degrees from that lowermost portion of that ferrule-like terminal.

12 Claims, 8 Drawing Figures

LOW PROFILE FUSE CLIP

This is a continuation of application Ser. No. 779,319 filed Mar. 21, 1977, now abandoned.

BACKGROUND OF THE INVENTION

Fuse clips for the ferrule-like terminals of electric fuses customarily have bases, which can abut supports, and arms which extend upwardly from those bases to accommodate those ferrule-like terminals. The arms of many of those fuse clips have concave inner surfaces which are intended to provide surface-to-surface contacts between those arms and those ferrule-like terminals. Those arms frequently are dimensioned to hold all portions of the ferrule-like terminals out of engagement with the bases of the fuse clips, so those concave surfaces can constitute the sole supports and contacts for those ferrule-like terminals.

SUMMARY OF THE INVENTION

The fuse clip provided by the present invention has a base from which two arms extend upwardly to grip a ferrule-like terminal of an electric fuse. The upper ends of those arms are located below the level of the top of the ferrule-like terminal; and hence the diameter of that ferrule-like terminal, and not the heights of those arms, largely determines the height of the space required by the fuse and the fuse clip. The upper surface of the base has a line contact with the lowermost portion of the ferrule-like terminal, and each of the two arms also has a line contact with that ferrule-like terminal which is displaced at least one hundred degrees from that lowermost portion of that ferrule-like terminal. It is, therefore, an object of the present invention to provide a fuse clip, for a ferrule-like terminal of an electric fuse, that has a base from which two arms extend upwardly to grip that ferrule-like terminal, that has a line contact between that base and the lowermost portion of that ferrule-like terminal, and that has line contacts between those two arms and that ferrule-like terminal which are displaced at least one hundred degrees from that lowermost portion of that ferrule-like terminal.

The arms, of the fuse clip provided by the present invention, normally define a space which is smaller than a ferrule-like terminal of an electric fuse; but those arms can be forced to move far enough apart to make that space as large as that ferrule-like terminal. The restorative forces, which are developed within that fuse clip as those arms are forced to move further apart, will provide the contact pressure between that fuse clip and that ferrule-type terminal. By providing three line contacts, rather than two surface-to-surface contacts, between the fuse clip and the ferrule-type terminal, the fuse clip of the present invention is able to provide higher-than normal contact pressures with lower-than normal restorative forces. It is, therefore, an object of the present invention to provide a fuse clip which has three line contacts with a ferrule-like terminal held thereby to provide higher-than-normal contact pressures with lower-than-normal restorative forces.

Each of the arms of the fuse clip provided by the present invention has a terminal-engaging surface thereon; and, whenever that fuse clip is in an unstressed condition, the shortest straightline distance between those two surfaces is sixty-five percent or more of the diameter of the terminal which is to be held by that fuse clip. That distance is appreciably larger than the shortest straight-line distance between the terminal-engaging surfaces of many prior fuse clips. This is desirable; because it means that less force is needed to insert a ferrule-like terminal into position within the fuse clip of the present invention than is needed to insert that ferrule-like terminal into position within a prior fuse clip. Similarly, it means that less force is needed to remove a ferrule-like terminal from the fuse clip of the present invention than is needed to remove that ferrule-like terminal from a prior fuse clip. It is, therefore, an object of the present invention to provide a fuse clip that has terminal-engaging surfaces on the arms thereof which are, in the unstressed condition of that fuse clip, spaced apart a distance which is sixty-five percent or more of the diameter of the terminal which is to be held by that fuse clip.

The fuse clip of the present invention has securing projections that extend downwardly from, and below the bottom of, the base; and bends secure those securing projections to that base. In one preferred embodiment of that fuse clip, those bends start at lines which are spaced inwardly of the vertical boundaries of that fuse clip, and those bends and the securing projections are dimensioned so no parts of those securing projections project beyond those vertical boundaries. As a result, the horizontal dimensions of the space required by that preferred embodiment of fuse clip are fixed by the sizes and shapes of the arms of that fuse clip and not by the sizes or shapes of the bends or securing projections. It is, therefore, an object of the present invention to provide a fuse clip with securing projections extending downwardly from, and below the bottom of, the base and that are secured to that base by bends which are dimensioned so no parts of those securing projections project beyond the vertical boundaries of that fuse clip.

Other and further objects and advantages of the present invention should become apparent from an examination of the drawing and accompanying description.

In the drawing and accompanying description two preferred embodiments of the present invention are shown and described but it is to be understood that the drawing and accompanying description are for the purpose of illustration only and do not limit the invention and that the invention will be defined by the appended claims.

DESCRIPTION OF THE PREFERRED EMBODIMENTS

Figure 1:
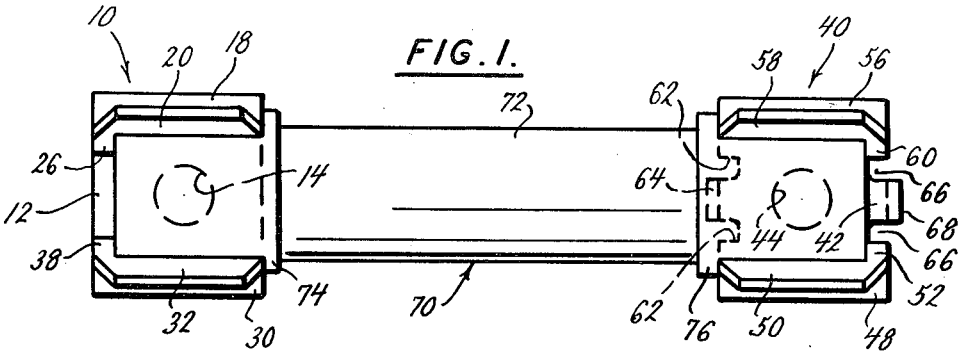
FIG. 1 is a plan view of two preferred embodiments of low profile fuse clips which are made in accordance with the principles and teachings of the present invention and which are shown holding a ferrule-equipped cartridge-type electric fuse.
Figure 2:
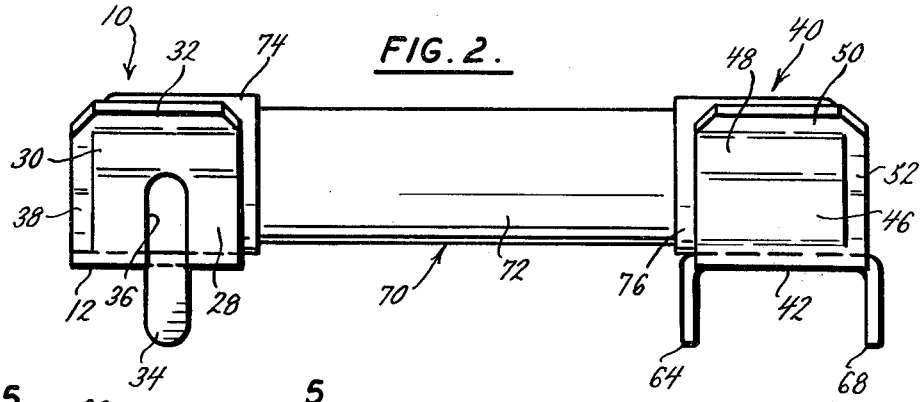
FIG. 2 is a side view of the fuse clips and fuse of FIG. 1.
Figure 3:
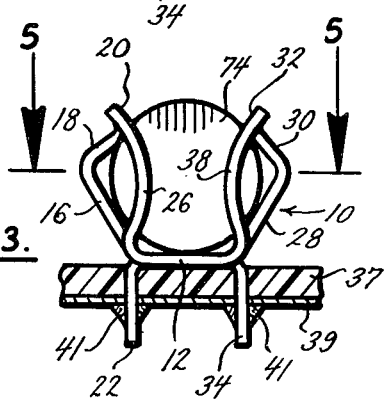
FIG. 3 is an elevational view of the left-hand end of the left-hand fuse clip and of the left-hand end of the fuse of FIG. 1 and is a sectional view through a circuit board on which that fuse clip is mounted.

Referring particularly to FIGS. 1-3 and 5-7, the numeral 10 generally denotes a low profile fuse clip which is made in accordance with the principles and teachings of the present invention. That fuse clip has a base 12 which is planar, and hence can be held in engagement with a surface of a circuit board or other support. The numeral 14 in FIGS. 1, 5 and 7 denotes a hole in the center of that base; but that hole is provided for tooling purposes to facilitate the manufacture of that fuse clip, and it is not essential to the operation or function of that fuse clip. The numeral 16 denotes an outwardly and upwardly inclined portion of the left-hand arm of the fuse clip 10; and the numeral 18 denotes an inwardly and upwardly inclined portion of that arm. As shown particularly by FIG. 6, those portions of that arm are substantially planar and they coact to subtend an obtuse interior angle. The numeral 20 denotes an outwardly and upwardly inclined portion of the left-hand arm of the fuse clip 10; and that portion is substantially planar and it coacts with the portion 18 to subtend an obtuse exterior angle. The numeral 26 denotes an end stop for fuse clip 10 which is arcuate until it merges into the substantially-planar portion 20. The numeral 22 denotes a securing projection which is punched out of the outwardly and upwardly inclined portion 16; and the numeral 24 denotes an opening in that outwardly and upwardly inclined portion which was formed as that securing projection was formed.

The numeral 28 denotes an outwardly and upwardly inclined portion of the right-hand arm of the fuse clip 10; and the numeral 30 denotes an inwardly and upwardly inclined portion of that arm. As shown particularly by FIG. 6, those portions of that arm are substantially planar and they coact to subtend an obtuse interior angle. The numeral 32 denotes an outwardly and upwardly inclined portion of the right-hand arm of the fuse clip 10; and that portion is substantially planar and it coacts with the portion 30 to subtend an obtuse exterior angle. The numeral 38 denotes an end stop for fuse clip 10 which is arcuate until it merges into the substantially-planar portion 32. The numeral 34 denotes a securing projection which is punched out of the outwardly and upwardly inclined portion 28; and the numeral 36 denotes an opening in that outwardly and upwardly inclined portion which was formed as that securing projection was formed. The right-hand arm of the fuse clip 10 is made as a mirror image of the left-hand arm of that fuse clip.

The securing projections 22 and 34 are long enough to extend through openings in a circuit board which is generally denoted by the numeral 37; and the lower ends of those securing projections extend downwardly below the level of the foil 39 at the lower surface of that circuit board. The normal unstressed spacing between the confronting surfaces of the securing projections 22 and 34 is such, relative to the spacing between the openings in circuit board 37 for those securing projections, that those securing projections will coact with those openings to provide an initial securement of fuse clip 10 to that circuit board. That initial securement and solder 41, which mechanically secures and electrically bonds those securing projections to the foil 39, provide full and solid support for fuse clip 10. As a result, neither a rivet, a bolt, a screw nor any other fastener is needed to secure that fuse clip to the circuit board 37. Consequently, the upper surface of the base 12 of that fuse clip is not overlain by any part of a rivet, a bolt, a screw or any other fastener.

The bends between the base 12 and the securing projections 22 and 34 start at lines which are spaced well inwardly of the vertical boundaries which are defined by the arms of fuse clip 10. As a result, no part of either of those securing projections will extend laterally outwardly beyond those vertical boundaries.

Figure 8:
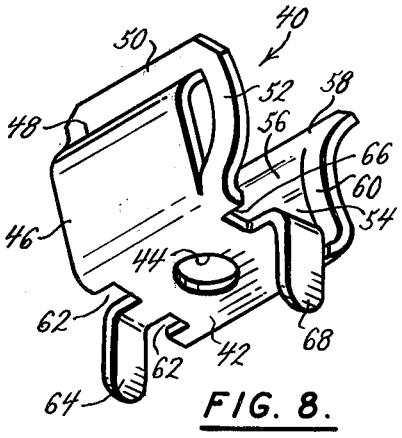
FIG. 8 is a perspective view of the right-hand fuse clip of FIG. 1 after that fuse clip has been rotated approximately forty-five degrees in the clockwise direction from the position of FIG. 1.

Referring particularly to FIGS. 1, 2, 3 and 8, the numeral 40 generally denotes a second low profile fuse clip which is made in accordance with the principles and teachings of the present invention. That fuse clip has a base 42 which is planar, and hence can be held in engagement with a surface of a circuit board or other support. A hole 44 is formed in the center of the base 42, as shown by FIGS. 1 and 8; but that hole is provided for tooling purposes to facilitate the manufacture of that fuse clip, and it is not essential to the operation or function of that fuse clip. The numeral 46 denotes an outwardly and upwardly inclined portion of the left-hand arm of the fuse clip 40; and the numeral 48 denotes an upwardly and inwardly inclined portion of that arm. As shown particularly by FIG. 4, those portions of that arm are substantially planar and they coact to subtend an obtuse interior angle. The numeral 50 denotes an outwardly and upwardly inclined portion of the left-hand arm of the fuse clip 40; and that portion is substantially planar and it coacts with the portion 48 to subtend on obtuse exterior angle. The numeral 52 denotes an end stop for fuse clip 40 which is arcuate until it merges into the substantially-planar portion 50.

The numeral 54 denotes an outwardly and upwardly inclined portion of the right-hand arm of the fuse clip 40; and the numeral 56 denotes an inwardly and upwardly inclined portion of that arm. As shown particularly to FIG. 4, those portions of that arm are substantially planar and they coact to subtend an obtuse interior angle. The numeral 58 denotes an outwardly and upwardly inclined portion of the right-hand arm of the fuse clip 40; and that portion is substantially planar and it coacts with the portion 56 to subtend an obtuse exterior angle. The numeral 60 denotes an end stop for fuse clip 40 which is arcuate until it merges into the substantially-planar portion 58. The right-hand arm of fuse clip 40 is a mirror image of the left-hand arm of that fuse clip.

The numeral 62 denotes shallow notches which are formed in the left-hand end of the base 42 of the fuse clip 40, as that fuse clip is viewed in FIG. 1. The numeral 64 denotes a securing projection which is bent downwardly from the plane of that base; and the bend between that base and that securing projection starts at a line which is defined by the inner ends of the notches 62. That line is spaced inwardly of the left-hand end of base 42. By having the start of that bend spaced inwardly of the left-hand end of base 42, the present invention enables that bend to be a gentle rather than an abrupt ninety degree bend. Such a bend has far less internal stress than does an abrupt ninety degree bend. The numeral 66 denotes shallow notches which are formed in the right-hand end of the base 42, as that fuse clip is viewed in FIG. 1. A securing projection 68 is bent downwardly from the plane of that base; and the bend between that base and that securing projection starts at a line which is defined by the inner ends of the notches 66. That line is spaced inwardly of the right-hand end of base 42. By having the start of that bend spaced inwardly of the right-hand end of base 42, the present invention enables that bend to be a gentle rather than an abrupt ninety degree bend. Such a bend has far less internal stess than does an abrupt ninety degree bend.

Figure 4:
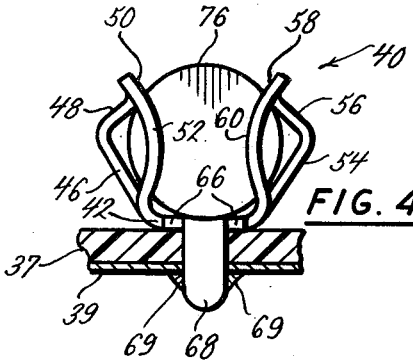
FIG. 4 is an elevational view of the right-hand end of the right-hand fuse clip and of the right-hand end of the fuse of FIG. 1 and is another sectional view of the circuit board on which that fuse clip is mounted.
Figure 6:
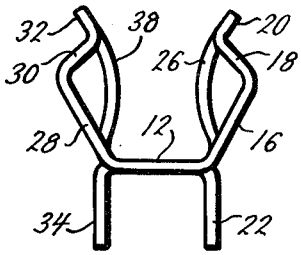
FIG. 6 is an elevational view of the right-hand end of the left-hand fuse clip of FIG. 1.
Figure 7:
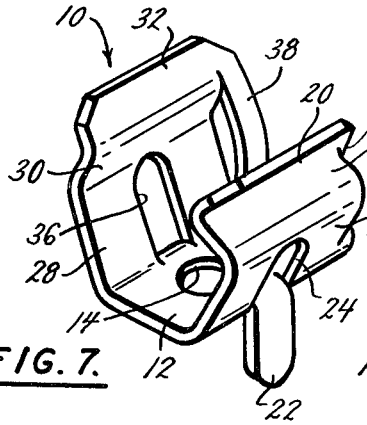
FIG. 7 is a perspective view of the left-hand fuse clip of FIG. 1 as that fuse clip appears after it has been rotated approximately one hundred and thirty-five degrees in the clockwise direction from the position of FIG. 1.
Figure 5:
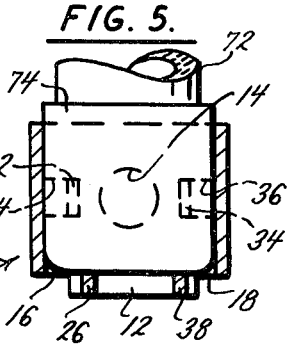
FIG. 5 is a sectional view through the left-hand fuse clip of FIG. 1, and it is taken along a plane indicated by the line 5—5 in FIG. 3.

As indicated by FIG. 4, the securing projections 64 and 68 will extend downwardly through openings in the circuit board 37, and they will extend downwardly beyond the foil 39 on the lower face of that circuit board. The normal un-stressed spacing between the confronting surfaces of the securing projections 64 and 63 is such, relative to the spacing between the openings in current board 37 for those securing projections, that those securing projections will coact with those openings to provide an initial securement of fuse clip 40 to that circuit board. That initial securement and solder 69, which mechanically secures and electrically bond those securing projections to the foil 39, provide full and solid support for fuse clip 40. As a result, neither a rivet, a screw, a bolt nor any other fastener is needed to secure that fuse clip to that circuit board. Consequently, the upper surface of the base 42 of that fuse clip is not overlain by any part of a rivet, a bolt, a screw or any other fastener.

The numeral 70 denotes a ferrule-equipped, cartridge-type fuse which has a tubular casing 72 and ferrule-like terminals 74 and 76. One standard size of ferrule-equipped, cartridge-type fuse which can be held by the fuse clips 10 and 40 has an overall length of one and one-quarter inches and has terminals with diameters of one-quarter of an inch. The terminal 74 is held by the fuse clip 10 whereas the ferrule 76 is held by the fuse clip 40. In actual practice, each of the ferrule-like terminals 74 and 76 will be held by the same kind of fuse clip, namely by two fuse clips 10 or by two fuse clips 40. The fuse clip 10 and the specifically-different fuse clip 40 were shown mounted on the same circuit board to minimize the number of views needed in the drawing.

It will be noted that the bend which interconnects the portions 18 and 20 of the left-hand arm of the fuse clip 10 engages the ferrule-like terminal 74 along a line which is spaced from the lowermost portion of that ferrule-like terminal by an angle at least as great as one hundred degrees. Similarly, the bend which interconnects the portions 30 and 32 of the right-hand arm of that fuse clip engages the ferrule-like terminal 74 along a line which is spaced from the lowermost portion of that ferrule-like terminal by an angle at least as great as one hundred degrees. The vertical components of the forces which those bends will apply to that ferrule-like terminal will provide intimate line contact between that lowermost portion of that ferrule-like terminal and the upper surface of the base 12.

The left-hand arm of fuse clip 10 is formed so the only portion of that arm which can engage the ferrule-like terminal 74, whenever that ferrule-like terminal is assembled with that fuse clip, is the bend which interconnects the portions 18 and 20 of that left-hand arm. Similarly, the right-hand arm of fuse clip 10 is formed so the only portion of that arm which can engage the ferrule-like terminal 74, whenever that ferrule-like terminal is assembled with that fuse clip, is the bend which interconnects the portions 30 and 32 of that right-hand arm. The base 12 is substantially planar, and hence the only portion of that base which can engage the ferrule-like terminal 74, whenever that ferrule-like terminal is assembled with fuse clip 10, is the center of that base. All of this means that the fuse clip 10 will provide just three line contacts between itself and the ferrule-like terminal 74; and all of the restorative forces, which are developed within that fuse clip whenever that ferrule-like terminal is assembled with that fuse clip, will be concentrated at those three line contacts. Similarly, the left-hand arm of fuse clip 40 is formed so the only portion of that arm which can engage the ferrule-like terminal 76, whenever that ferrule-like terminal is assembled with that fuse clip, is the bend which interconnects the portions 48 and 50 of that left-hand arm. Also, the right-hand arm of fuse clip 40 is formed so the only portion of that arm which can engage the ferrule-like terminal 76, whenever that ferrule-like terminal is assembled with that fuse clip, is the bend which interconnects the portions 56 and 58 of that right-hand arm. The base 42 is substantially planar, and hence the only portion of that base which can engage the ferrule-like terminal 76, whenever that ferrule-like terminal is assembled with fuse clip 40, is the center of that base. All of this means that the fuse clip 40 will provide just three line contacts between itself and the ferrule-like terminal 76; and all of the restorative forces, which are developed within that fuse clip whenever that ferrule-like terminal is assembled with that fuse clip, will be concentrated at those three line contacts.

The diameter of the ferrule-like terminal 74 is, whenever the fuse clip 10 is in an unstressed condition, larger than the shortest straight-line distance between the bend, which interconnects the portions 18 and 20 of the left-hand arm of the fuse clip 10, and the bend which interconnects the portions 30 and 32 of the right-hand arm of that fuse clip. As a result, those arms must bend away from each other as that ferrule-like terminal is forced downwardly between those bends. Similarly, the diameter of the ferrule-like terminal 76 is, whenever the fuse clip 40 is in an unstressed condition, larger than the shortest straight-line distance between the bend, which interconnects the portions 48 and 50 of the left-hand arm of the fuse clip 40, and the bend which interconnects the portions 56 and 58 of the right-hand arm of that fuse clip. As a result, those arms must bend away from each other as that ferrule-like terminal is forced downwardly between those bends. In the preferred embodiments of the present invention, each of those shortest straight-line distances is at least sixty-five percent of the diameter of the appropriate ferrule-like terminal. This means that the terminal-receiving spaces that are defined by the fuse clips 10 and 40 are, whenever those fuse clips are in their unstressed conditions, larger than the corresponding terminal-receiving spaces defined by many prior fuse clips. This is desirable; because it means that smaller-than-normal forces can be used to insert a ferrule-like terminal into, or to remove such a terminal from, fuse clip 10 or fuse clip 40.

It should be noted that although smaller-than-normal forces can be used to insert a ferrule-like terminal into, or to remove such a terminal from, fuse clip 10 or fuse clip 40, those fuse clips provide contact pressures which are higher-than-normal. Specifically, each of the fuse clips 10 and 40 provides three line contacts rather than two surface-to-surface contacts with the ferrule-like terminal held thereby. The consequent reduced contact areas enable smaller-than-normal forces to provide higher-than-normal contact pressures. Also, the arms of fuse clip 10 will bend about axes which are defined by the sides of the base 12; and hence those arms will have short moment arms. Similarly, the arms of fuse clip 40 will bend about axes which are defined by the sides of the base 42; and hence those arms will have short moment arms. All of this means that the fuse clips of the present invention provide desirably-high contact pressures but require smaller-than-normal insertion and removal forces.

To demonstrate the hereinbefore-reported facts, two fuse blocks were made by using four fuse clips 10 and two further fuse blocks were made by using four BUSS One-Piece Clip And Terminals No. 5678-14. The unstressed distance between the re-entrant bends at the upper ends of the inner faces of the arms of fuse clip 10 is two hundred thousandths of an inch whereas the unstressed distance between the re-entrant bends 5678-14 is one hundred and thirty-five thousandths of an inch. A ferrule-equipped cartridge-type fuse, like the fuse 70 in FIGS. 1 and 2, was inserted in and removed from each of those four fuse blocks four separate times. The highest insertion force, the lowest insertion force, and the average insertion force for each block, the highest removal force, the lowest removal force and the average removal force for each block have been recorded in the following chart, and are expressed in units of pounds. Further, four identical copper cylinders, each of which had a diameter identical to that of ferrule-like terminal 74 or 76, were inserted in the four fuse blocks; and those fuse blocks were connected in series relation. Progressively-larger values of current were passed through those series-connected fuse blocks, and the progressively-larger temperatures at one fuse clip on each of the four fuse blocks were sensed by thermocouples and have been recorded in the said chart. Sufficient time was given between successive increases in the current to permit the temperatures of all of the fuse clips and copper cylinders to stabilize. Moreover, the voltage drops across the connections between the fuse clips and those copper cylinders were determined and have been recorded in the said chart. An inspection of that chart shows that the average insertion forces and the average removal forces for fuse clip 10 are substantially smaller than the average insertion forces and the average removal forces for fuse clip 5678-14. Yet, the temperature readings and the voltage drop readings in that chart prove that the contact pressures provided by fuse clip 10 are greater than the contact pressures provided by fuse clip 5678–14. Specifically, as shown by the temperature readings at current levels of 25 and 30 amperes—where the effect of contact pressures and of contact resistances were most significant and were most readily apparent—the temperature of the fuse clips 10 were substantially smaller than the temperatures of the fuse clips 5678–14. Further, the average voltage drops across the connections, between the fuse clip 10 and the copper cylinders were less than the voltage drops across the connections between the fuse clips 5678–14 and the copper cylinders.

| | MAGNITUDE OF INSERTION FORCES (pounds) | | | |
|---|---|---|---|---|
| | 1st Block With 5678-14 Fuse Clips | 2nd Block With 5678-14 Fuse Clips | 1st Block With Fuse Clips 10 | 2nd Block With Fuse Clips 10 |
| Highest | 10.8 | 11.7 | 9.4 | 8.9 |
| Lowest | 10.4 | 11.3 | 9.1 | 8.2 |
| Average | 10.6 | 11.5 | 9.3 | 8.6 |
| | MAGNITUDE OF REMOVAL FORCES (pounds) | | | |
| Highest | 11.8 | 11.9 | 10.6 | 9.7 |
| Lowest | 11.1 | 10.9 | 9.7 | 9.2 |
| Average | 11.4 | 11.8 | 10.5 | 9.4 |

| | CURRENT-TEMPERATURE RELATION | | | |
|---|---|---|---|---|
| Current In Amperes | 1st Block With 5678-14 Fuse Clips | 2nd Block With 5678-14 Fuse Clips | 1st Block With Fuse Clips 10 | 2nd Block With Fuse Clips 10 |
| 5 | 27° C. | 28° C. | 28° C. | 28° C. |
| 10 | 31 | 31 | 32 | 32 |
| 15 | 35 | 36 | 34 | 35 |
| 20 | 41 | 41 | 40 | 41 |
| 25 | 52 | 52 | 47 | 47 |
| 30 | 59 | 60 | 53 | 54 |

| | VOLTAGE DROP ACROSS CONNECTION BETWEEN FUSE CLIP AND COPPER CYLINDER | | | |
|---|---|---|---|---|
| | 1st Block With 5678-14 Fuse Clips | 2nd Block With 5678-14 Fuse Clips | 1st Block With Fuse Clips 10 | 2nd Block With Fuse Clips 10 |
| Volts | .0001 | .0004 | .0002 | .0001 |

The readings that were obtained with the fuse blocks which were equipped with fuse clips 10 are representative of readings which could be obtained with any fuse blocks which were equipped with fuse clips 40; because the latter fuse clips differ from the former fuse clips only in the locations of the securing projections thereof. Consequently, whether fuse clips 10 or 40 are used, higher-than-normal contact pressures, lower-than-normal contact resistances, and lower-than-normal insertion and removal forces will be provided.

It would have been a material advance in the art to increase contact pressures while keeping the insertion and removal forces the same. However, the present invention has accomplished far more—by reducing insertion and removal forces while providing higher-than-normal contact pressures and lower-than-normal contact resistances.

It will be noted that the upper ends of the arms of fuse clips 10 and 40 are located below the levels of the tops of the ferrule-like terminals 74 and 76 whenever those ferrule-like terminals are in the positions of FIGS. 1–5. Also it will be noted that the lower surfaces of those ferrule-like terminals are spaced from the upper surface of the circuit board 37 only by the thicknesses of the bases 12 and 42, respectively. As a result, the height of the space required by the fuse clip 10 and the ferrule-like terminal 74 is effectively reduced to an irreducible minimum. Similarly, the height of the space required by the fuse clip 40 and the ferrule-like terminal 76 is effectively reduced to an irreducible minimum.

FIGS. 2–4 and 6–7 show the end stops 26, 38, 52 and 60 defined by slits that extend downwardly to the bases 12 and 42, respectively. Such long slits enable the upper ends of those end stops to apply forces to the upper ends of the arms of fuse clips 10 and 40 which help resist separating movement of those end stops. However, if those forces are not needed, the slits which form those end stops can be terminated above the levels of the bases 12 and 42.

The spacing between the projections 64 and 68 of the fuse clip 40 enables those projections to be telescoped into openings in presently-marketed circuit boards. Where the spacing between such openings can be reduced, the bends at the upper ends of those projections can be moved inwardly so no parts of those projections will extend outwardly beyond the vertical boundaries defined by the ends of the base 42.

Whereas the drawing and accompanying description have shown and described two preferred embodiments of the present invention, it should be apparent to those skilled in the art that various changes may be made in the form of the invention without affecting the scope thereof.

What I claim is:

1. A fuse holder that can releasably hold a ferrule-like terminal of a cartridge-type electric fuse and that is securable to a circuit board and that comprises a unitary metal stamping which has a substantially-planar base, a first arm that extends upwardly from one side of said base, a second arm that extends upwardly from the opposite side of said base, a securing projection that extends downwardly below the level of the bottom of said base to telescope into an opening in said circuit board, a second securing projection that extends downwardly below the level of said bottom of said base to telescope into a second opening in said circuit board, said securing projections being spaced apart to coact with said openings in said circuit board to resist shifting of said fuse holder relative to said circuit board, said arms having the upper ends thereof inclined relative to each other to diverge outwardly and upwardly from each other, said uper ends of said arms serving as cam surfaces which can respond to movement of said ferrule-like terminal of said cartridge-type fuse toward said base to cam said upper ends of said arms away from each other and thereby permit said ferrule-like terminal of said cartridge-type fuse to pass between said upper ends of said arms until the bottom of said ferrule-like terminal of said cartridge-type fuse abuts a portion of said base, said arms having the lower ends thereof substantially planar and inclined relative to each other to diverge outwardly and upwardly from each other, said arms having portions that are intermediate said upper ends and said lower ends thereof and that are substantially planar and are inclined relative to each other to converge inwardly and upwardly toward each other, said portion of said base and said bottom of said ferrule-like terminal of said cartridge-type fuse providing a first line contact between said fuse holder and said ferrule-like terminal of said cartridge-type fuse, one of said arms having a portion thereof which engages said ferrule-like terminal of said cartridge-type fuse to provide a second line contact between said fuse holder and said ferrule-like terminal of said cartridge-type fuse that is displaced at least one hundred degrees from said first line contact between said fuse holder and said ferrule-like terminal of said cartridge-type fuse and the other of said arms having a portion thereof which engages said ferrule-like terminal of said cartridge-type fuse to provide a third line contact between said fuse holder and said ferrule-like terminal of said cartridge-type fuse that is displaced at least one hundred degrees from said first line contact between said fuse holder and said ferrule-like terminal of said cartridge-type fuse, the upper edges of said upper ends of said arms not extending above the level of the top of said ferrule-like terminal of said cartridge-type fuse whenever said bottom of said ferrule-like terminal of said cartridge-type fuse abuts said base, whereby said fuse holder has a low profile.

2. A fuse holder as claimed in claim 1 wherein said portions of said arms, which engage said ferrule-like terminal of said cartridge-type fuse to provide said second and said third line contacts between said fuse holder and said ferrule-like terminal of said cartridge-type fuse, hold all other portions of said arms out of engagement with said ferrule-like terminal of said cartridge-type fuse.

3. A fuse holder than can releasably hold a ferrule-like terminal of a cartridge-type electric fuse and that comprises a unitary metal stamping which has a substantially-planar base, a first arm that extends upwardly from one side of said base, a second arm that extends upwardly from the opposite side of said base, said arms having the lower ends thereof substantially planar and inclined relative to each other to diverge outwardly and upwardly from each other, said arms having further portions thereof that are substantially planar and are inclined relative to each other to converge inwardly and upwardly toward each other, said base having a portion thereof which is engageable by said ferrule-like terminal of said cartridge-type fuse in line contact, each of said arms having a ferrule-engaging portion adjacent the upper ends of said further portions of said arms that engages a circumferentially-displaced portion of said ferrule-like terminal of said cartridge-type fuse in line contact, said arms being formed and dimensioned so all other portions of said arms are wholly spaced from said ferrule-like terminal of said cartridge-type fuse whenever said ferrule-like terminal of said cartridge-type fuse is in said line contact with said portion of said base and said ferrule-engaging portions of said arms are in said line contacts with said circumferentially-displaced portions of said ferrule-like terminal of said cartridge-type fuse, whereby all current that flows between said fuse holder and said ferrule-like terminal of said cartridge-type fuse is concentrated at said three line contacts, and each of said ferrule-engaging portions being displaced at least one hundred degrees from said portion of said base.

4. A fuse holder as claimed in claim 3 including an end stop which is punched out of one end of one of said arms to make the lower end of said end stop effectively independent of the lower end of said one arm but to make the upper end of said end stop move with the upper end of said one arm, a second end stop which is punched out of the corresponding end of the other of said arms to make the lower end of said second end stop effectively independent of the lower end of said second arm but to make the upper end of said second end stop move with the upper end of said second arm, and bends intermediate said base and said end stops which resist bending of said end stops relative to said base, whereby said end stops apply forces to the upper ends of said arms which help resist separating movement of said upper ends of said arms.

5. A fuse holder as claimed in claim 3 wherein the shortest straight-line distance between said ferrule-engaging portions of said arms is, whenever said fuse holder is in an unstressed condition, at least sixty-five percent of the diameter of said ferrule-like terminal.

6. A fuse holder as claimed in claim 5 wherein one of said arms is bendable about the line where it joins said base, wherein the other of said arms is bendable about the line where it joins said base, and wherein each of said ferrule-engaging portions of said arms has a moment arm that is less than the diameter of said ferrule-like terminal of said cartridge-type fuse, whereby said arms develop substantial restorative forces therein as said ferrule-like terminal of said cartridge-type fuse is forced between said ferrule-engaging portions of said arms.

7. A fuse holder as claimed in claim 3 including a securing projection that extends downwardly below the level of the bottom of said base to telescope into an opening in said circuit board, a second securing projection that extends downwardly below the level of said bottom of said base to telescope into a second opening in said circuit board, a bend intermediate said base and the first said securing projection, and a second bend intermediate said base and said second securing projection, said securing projections being spaced apart to coact with said openings in said circuit board to resist shifting of said fuse holder relative to said circuit board, said bends starting at points which are spaced inwardly of the vertical boundaries of said fuse holder so said securing projections do not extend outwardly beyond said vertical boundaries.

8. A fuse holder as claimed in claim 7 wherein said bends are adjacent sides of said base and wherein said securing projections are punched out of said arms.

9. A fuse holder as claimed in claim 7 wherein said bends are adjacent the ends of said base and wherein notches extend inwardly from said ends of said base at the opposite sides of said bends.

10. A fuse holder as claimed in claim 7 wherein said securing projections coact with said openings in said circuit board to hold said fuse holder in assembled relation with said circuit board prior to the soldering of said securing projections to said circuit board.

11. A fuse holder that can releasably hold a ferrule-like terminal of a cartridge-type electric fuse and that comprises a unitary metal stamping which has a substantially-planar base, a first arm that extends upwardly from one side of said base, a second arm that extends upwardly from the opposite side of said base, said arms including lower ends which are substantially planar, and which are inclined relative to each other to diverge outwardly and upwardly from each other, said arms having further portions thereof which are substantially planar and which are inclined relative to each other to converge inwardly and upwardly toward each other, one of said arms bendable about the line where it joins at said base, the other of said arms bendable about the line where it joins at said base, said base having a portion thereof which is engageable by said ferrule-like terminal of said cartridge-type fuse in line contact, each of said arms having a ferrule-engaging portion that engages a circumferentially-displaced portion of said ferrule-like terminal of said cartridge-type fuse in line contact, each of said ferrule-engaging portions of said arms having a moment arm that is less than the diameter of said ferrule-like terminal of said cartridge-type fuse, said arms being formed and dimensioned so all other portions of said arms are wholly spaced from said ferrule-like terminal of said cartridge-type fuse whenever said ferrule-like terminal of said cartridge-type fuse is in said line contact with said portion of said base and said ferrule-engaging portions of said arms are in said line contacts with said circumferentially-displaced portions of said ferrule-like terminal of said cartridge-type fuse, whereby said arms develop substantial restorative forces therein as said ferrule-like terminal of said cartridge-type fuse is forced between said ferrule-engaging portions of said arms, and whereby all current that flows between said fuse holder and said ferrule-like terminal of said cartridge-type fuse is concentrated at said three line contacts, and each of said ferrule-engaging portions being displaced at least one hundred degrees from said portion of said base.

12. A fuse holder that can releasably hold a ferrule-like terminal of a cartridge-type electric fuse and that comprises a unitary metal stamping which has a substantially-planar base, a first arm that extends upwardly from one side of said base, a second arm that extends upwardly from the opposite side of said base, said arms including lower, upper and intermediate portions each of which portions is substantially planar, with said intermediate portions being inclined inwardly and upwardly relative to said base, said base having a portion thereof which is engageable by said ferrule-like terminal of said cartridge-type fuse in line contact, each of said arms having a ferrule-engaging portion that engages a circumferentially-displaced portion of said ferrule-like terminal of said cartridge-type fuse in line contact, said arms being formed and dimensioned so all other portions of said arms are wholly spaced from said ferrule-like terminal of said cartridge-type fuse whenever said ferrule-like terminal of said cartridge-type fuse is in said line contact with said portion of said base and said ferrule-engaging portions of said arms are in said line contacts with said circumferentially-displaced portions of said ferrule-like terminal of said cartridge-type fuse, whereby all current that flows between said fuse holder and said ferrule-like terminal of said cartridge-type fuse is concentrated at said three line contacts, and each of said ferrule-engaging portions being displaced at least one hundred degrees from said portion of said base.

* * * * *